United States Patent [19]

Moss

[11] 4,435,148

[45] Mar. 6, 1984

[54] LOW POLLUTION METHOD OF BURNING FUELS

[75] Inventor: Gerald Moss, Wantage, England

[73] Assignee: Exxon Research and Engineering Co., Florham Park, N.J.

[21] Appl. No.: 360,413

[22] Filed: Mar. 22, 1982

[30] Foreign Application Priority Data

Mar. 24, 1981 [GB] United Kingdom ..... 8109214

[51] Int. Cl.[3] ..... F23D 19/02

[52] U.S. Cl. ..... 431/7; 431/170; 122/4 D; 110/245

[58] Field of Search ..... 431/7, 170; 122/4 D; 110/245

[56] References Cited

U.S. PATENT DOCUMENTS

| | | | |
|---|---|---|---|
| 3,699,903 | 10/1972 | King | 110/1 J |
| 4,019,314 | 4/1977 | Springmann | 60/39.02 |
| 4,026,679 | 5/1977 | Collin | 48/73 |
| 4,052,138 | 10/1977 | Gieck | 431/4 |
| 4,309,198 | 1/1982 | Moss | 48/197 |

FOREIGN PATENT DOCUMENTS

| | | |
|---|---|---|
| 13590 | 7/1980 | European Pat. Off. . |
| 901944 | 11/1944 | France . |
| 1183937 | 3/1970 | United Kingdom . |
| 1336563 | 11/1973 | United Kingdom . |
| 1486128 | 9/1977 | United Kingdom . |
| 1512677 | 6/1978 | United Kingdom . |
| 1530831 | 11/1978 | United Kingdom . |
| 2005822 | 4/1979 | United Kingdom . |
| 1564081 | 4/1980 | United Kingdom . |

*Primary Examiner*—Carroll B. Dority, Jr.
*Attorney, Agent, or Firm*—Edward H. Mazer

[57] ABSTRACT

A low pollution method of burning a fuel comprises gasifying the fuel in a gasifier bed containing particles which are fluidized by a fluidizing gas containing substantially no inert components. The resulting combustible gas is burned with air diluted with nitrogen to reduce $NO_x$ formation. In addition, $NO_x$ production from the nitrogen content of the fuel is reduced as a result of the gasification of the fuel to combustible gas before combustion with air. Preferably the gasifier bed contains CaO to fix sulfur from the fuel as CaS. In one embodiment, the gasifier bed (51) contains $CaSO_4$ and the fluidizing gas contains $H_2$, inter alia, which mediates the transfer to the fuel of chemically-bound oxygen from the $CaSO_4$ (which is thereby reduced to CaS). Particles containing CaS are passed to an oxidizer bed (72) wherein they are fluidized by air. The CaS is exothermically oxidized to $CaSO_4$ by extracting oxygen from the air which is thereby heated and substantially exhausted of oxygen. The hot $CaSO_4$ is transferred from the oxidizer bed (72) to the gasifier bed (51) for gasifying further amounts of fuel, and the hot oxygen-depleted air is cooled by heat exchange (in 80) with boiler feed water, and then added to combustion air (in 69) to reduce the peak flame temperature when the combustible gas is burned at the burner (56) thereby mitigating $NO_x$ production from reactions in the flame between oxygen and nitrogen from the atmosphere.

Because the fuel is gasified in the absence of diluents, the gasifier bed (51), combustible gas conduit (55), the burner (56) and gas circulation fans are of reduced sizes. The low pollution combustion of the fuel necessitates no modification of the furnace or boiler (84) and results in no increase in its operating costs or reduction in efficiency.

15 Claims, 2 Drawing Figures

LOW POLLUTION METHOD OF BURNING FUELS

Figure 1:
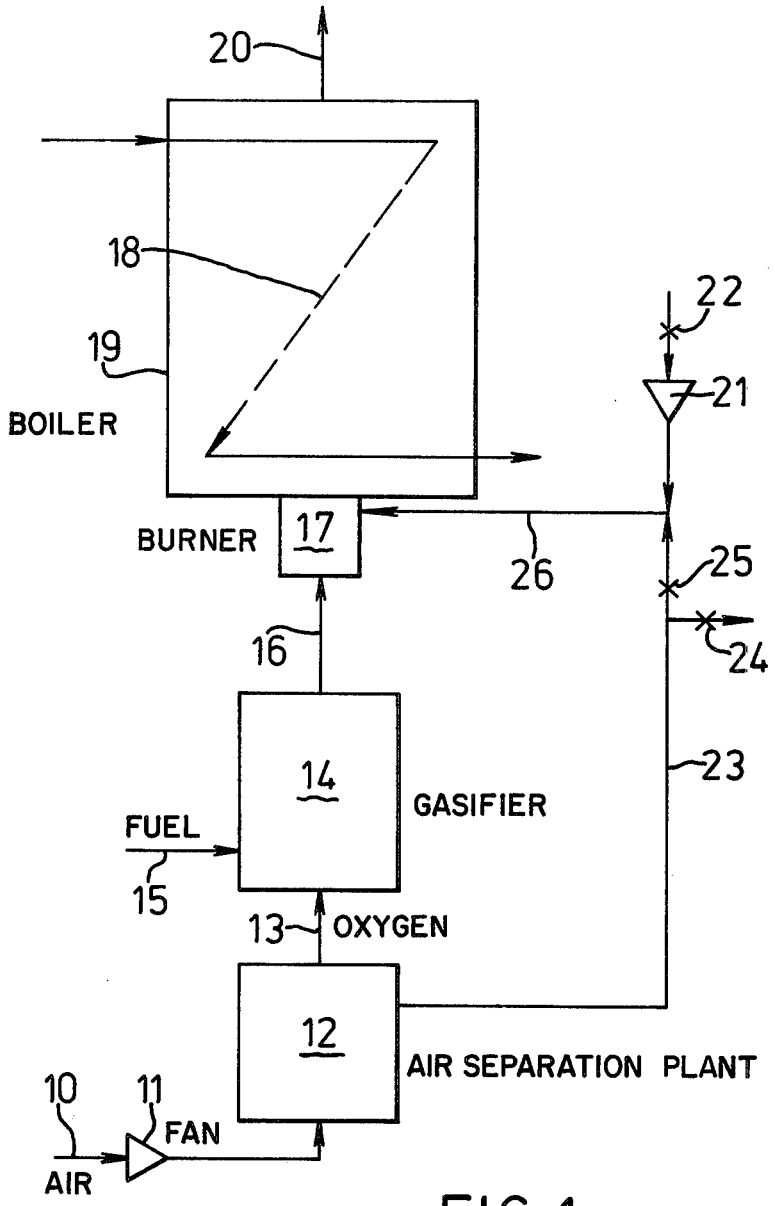

The present invention relates to a low pollution method of burning fuels.

It is already known that sulfur-containing fuel such as low quality fuel oils, coals or lignites, can be efficiently gasified by partial combustion with air in a fluidized bed containing calcium oxide to produced a hot (e.g. 900° C.) combustible fuel gas having a low sulfur content which can be burned in an existing boiler installation to raise steam (see, for example, UK patent specification Nos. 1,183,937 and 1,336,563).

The hot fuel gas contains a considerable proportion of nitrogen (e.g. from 45 to 65 vol %). Consequently, conduits and burners through which the hot fuel gas passes must be adequately sized to accommodate the nitrogen in addition to the other components of the fuel gas, the gasifier itself must be adequately large to deal with the volume of nitrogen passing therethrough, and the power and equipment required to pass air into the gasifier and to circulate the fuel gas to the burner must be adequate for the nitrogen in addition to other gases.

It has been found that gasification of a fuel followed by combustion provides the advantage that chemically-combined nitrogen contained as part of the fuel does not contribute significantly, if at all, to the formation of $NO_x$ in the burnt fuel gas. As a result, the concentration of $NO_x$ in the flue gas of a boiler installation in which the hot fuel gas is burned is considerably less (e.g. about 40 to 50%) than that found in an equivalent boiler installation in which the same primary fuel is burned directly to flue gas.

An object of the present invention is to provide a method and installation for burning a fuel to produce combustion products of low pollutant content.

The present invention provides a low pollution method of burning a fuel, comprising the steps of:

(a) passing the fuel into a dense phase fluidized bed of particles which are fluidized by a fluidizing gas substantially free of non-combustible inert components;

(b) partially oxidizing the fuel within the dense phase bed at an elevated partial oxidation temperature to produce a combustible gas which has a low content of non-combustible inert components;

(c) passing at least some of the combustible gas to a burner; and (d) burning the combustible gas in a flame at the burner with a combustion-supporting gas to which has been added a non-combustible inert gas to suppress or reduce the formation of pollutants in the resulting flue gas.

According to one type of embodiment, the partial oxidation of step (b) is effected with oxygen and/or steam substantially free of non-combustible inert substances. The oxygen may be obtained by separation from air.

The said non-combustible inert gas may be nitrogen. The nitrogen may be obtained by separating oxygen from air (e.g. by liquefaction or selective adsorption, inter alia).

When the oxygen is separated from air by a procedure comprising liquefying the air, considerable amounts of useful heat are made available, and preferably, at least some of this heat is recovered in at least one fluid selected from one or more of the following: water passing to a boiler; steam or other fluid passing to a boiler; at least part of a gas which is employed to convert the fluid to combustible gas.

According to another type of embodiment of the invention, the particles in the dense phased fluidized bed include particles comprising reactive calcium sulfate, and in which the fuel is partially oxidized within the bed at an elevated temperature by the transfer to the fuel of oxygen from calcium sulfate, which is thereby reduced to reactive calcium sulfide, optionally in the presence of a mediating gas and/or vapour moiety for mediating and/or promoting the said transfer of oxygen, contacting particles comprising reactive calcium sulfide in an oxidizing zone with a gas mixture comprising molecular oxygen and at least one gaseous component which is non-combustible and inert at conditions such that at least some reactive calcium sulfide is converted to reactive calcium sulfate which is re-used for the partial oxidation of further amounts of fuel, and such that a substantially oxygen-free non-combustible inert residue gas at an elevated temperature is produced, and employing said residue gas as the said non-combustible inert gas in step (d).

The said residue gas is preferably cooled by heat exchange with at least one fluid before addition to the said combustion supporting gas, and said fluid is selected from at least one of the following: water passing to a boiler, steam or other fluid passing to a boiler, at least part of the gas mixture which is suplied for conversion of the calcium sulfide to calcium sulfate.

The fuel may contain chemically-combined sulfur and/or chemically-combined nitrogen, and to mitigate pollution, the fluidized bed preferably comprises particles containing reactive calcium oxide which fixes sulfur from the fuel as reactive calcium sulfide to reduce the sulfur content of the combustible gas.

Preferably, particles containing reactive calcium sulfide are fluidized in a regeneration zone at a regeneration temperature by an oxygen-containing gas whereby reactive calcium sulfide is converted to reactive calcium oxide, which is used for fixing sulfur from further amounts of fuel in the dense phase fluidized bed, and at least one sulfur moiety is liberated.

The invention, in another aspect, provides a boiler installation comprising a dense phase fluidized bed fuel conversion zone wherein a fuel is partially oxidized within a dense phase fluidized bed which is fluidized by a fluidizing gas substantially free of non-combustible inert components to form a combustible gas which has a low content of non-combustible inert components, a burner connected to receive combustible gas from the said fuel conversion zone, means operable to provide a supply of non-combustible inert gas, means operable to provide a supply of combustion-supporting gas, and means for conducting a mixture of said non-combustible inert gas and said combustion-supporting gas to the burner to burn the combustible gas in a flame at the burner with a reduced peak flame temperature.

It will be appreciated from the foregoing that the method and installation of the invention enable a fuel which normally produces pollutant-rich waste gases, on combustion, to be burned using an existing furnace or boiler installation with only modifications to the burner, to produce low pollutant waste gases. This contrasts with previous expedients to reduce pollution from boilers and furnaces which have involved significant modifications in the structure of the furnace or boiler, and the addition of pollutant-reducing chemicals to the flue gas. Such previous expedients are relatively costly to implement. Another advantage of the invention is that low quality fuels containing relatively high proportions of sulfur and nitrogen can be burned in a conventional furnace or boiler installation with minor changes only to the burner and with the addition of the partial oxidizer with less pollutant in the resulting waste gases than would otherwise be the case in the unmodified furnace or boiler. Moreover, the efficiency of operation of the furnace or boiler is substantially unaffected by the use of the invention, and it would be expected that problems due to acid corrosion, acid smut emission and soot deposits would be substantially eliminated or reduced, tending to longer operating periods between shut-downs for maintenance.

Figure 2:
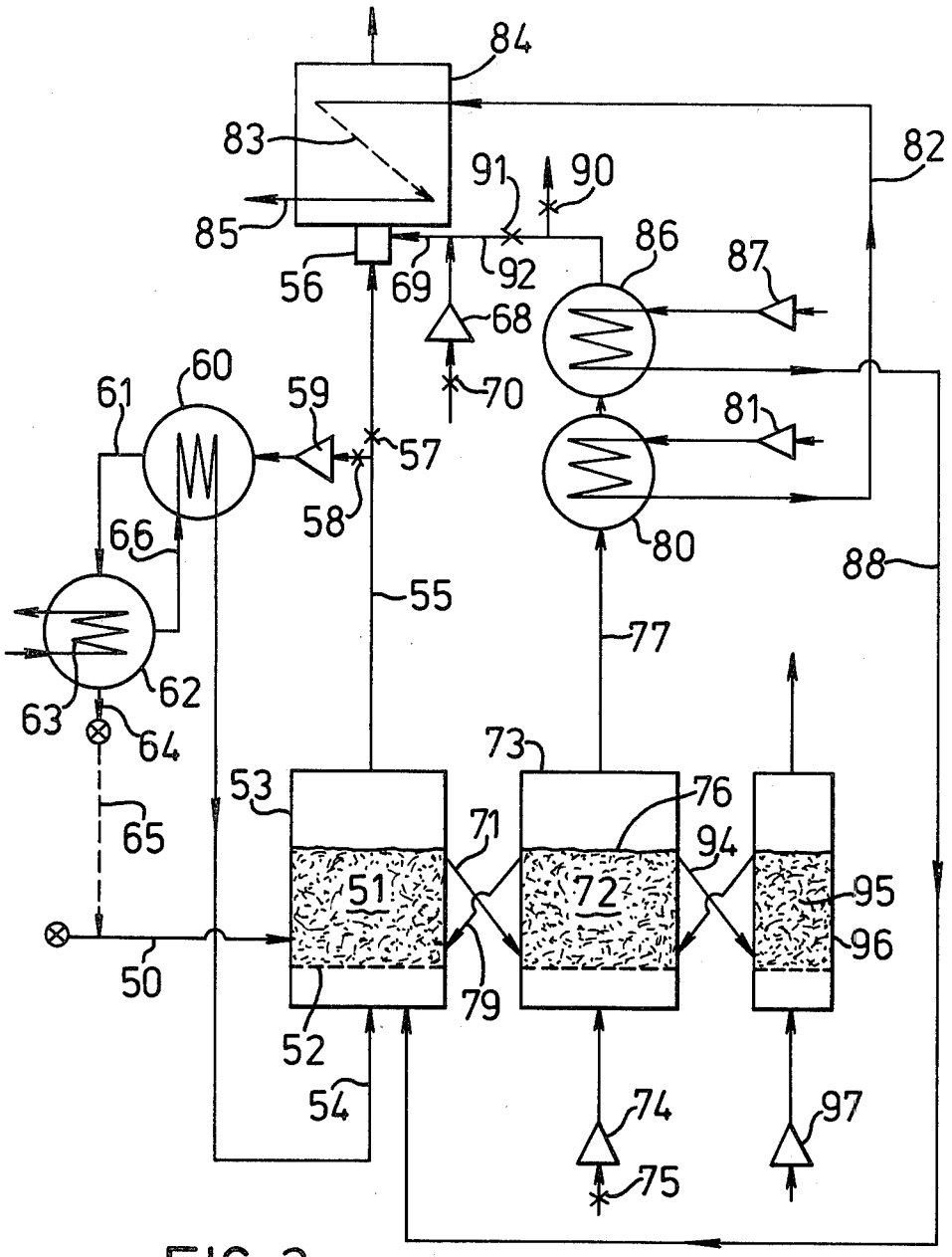

To illustrate the invention further, reference is now made to the accompanying diagrammatic drawings in which:

FIG. 1 is a chemical engineering flow diagram of the principal parts of a boiler installation according to the invention; and FIG. 2 is a chemical engineering flow diagram of the principal parts of another embodiment of a boiler installation according to the invention.

Referring first to FIG. 1, air is induced from the atmosphere via line 10 by a fan 11 and circulated to an air-separation plant 12. The air-separation plant may be of any type (e.g. of the air-liquefaction type or of the selective adsorption type) whereby at least two product streams are produced, one stream being substantially 100% oxygen and the other stream being substantially depleted of oxygen, and preferably being substantially free of oxygen. The oxygen stream is passed via line 13 to gasifier 14 to which is supplied a fuel from line 15. In the gasifier 14, the fuel is converted to a combustible gas which is substantially free of non-combustible inert components from the oxygen stream, and as a result, has a smaller volume than it otherwise would were it to contain such non-combustible inert components. In the instance where the fuel contains chemically-combined nitrogen (which is commonly present, particularly in low quality fuels which are advantageously used in the practice of the present invention), it is found that the conversion of fuel to combustible gas in the gasifier 14 produces a combustible gas which burns to produce a flue gas containing considerably less $NO_x$ than would be the case were the fuel to be burned directly to flue gas. Typically, the $NO_x$ content of the flue gas is reduced, as a result of the conversion in the gasifier 14, by from 45 to 55%. The benefit of reduced $NO_x$ in the flue gas resulting from gasification of the fuel is also obtained in the FIG. 2 embodiment described below. Moreover, when the fuel contains chemically-combined sulfur (as it normally does when the fuel is of a low quality), the gasifier preferably comprises a bed of particles containing calcium oxide which are fluidized by the oxygen stream supplied via line 13, and the fuel is converted to combustible gas by partial oxidation within the fluidized bed of CaO-containing particles so that the resulting combustible gas has a low content of sulfur compared to the fuel passed into the fluidized bed from line 15. The benefit of reduced sulfur pollutants in the flue gas resulting from desulfurizing gasification is also obtained with the FIG. 2 embodiment described below.

The combustible gas is recovered from the gasifier 14 and passed by line 16 to a burner 17. At the burner 17, the combustible gas is mixed with a combustion-supporting gas, e.g. air, and burned in a flame (not shown). Heat thus generated is recovered in the heat recovery tubes 18 of a boiler 19, and the burned combustion gases are discharged from the boiler 19 via line 20 for eventual passage to the atmosphere.

The combustion-supporting gas for this embodiment is air which is provided by a fan 21 via a regulating valve 22. If the air were to be passed directly to the burner, the combustion of the combustible gas in the flame at the burner 17 would generate considerable quantities of $NO_x$ due to the relatively high calorific value of the combustible gas and its relatively high peak flame combustion temperature which promotes the reaction between atmospheric nitrogen and oxygen. In order to reduce the quantity of $NO_x$ which is formed during combustion of the combustible gas resulting from the reaction of atmospheric nitrogen and oxygen, the air delivered by the fan 21 is mixed with at least some of the nitrogen-rich product stream from the air-separation plant 12. Preferably, the nitrogen-rich product stream is preheated, e.g. by heat exchange with flue gas and/or other hot fluid, prior to being mixed with the combustion air. Alternatively, flue gas may be cooled by heat exchange with cold nitrogen-rich product stream, and the cool flue gas mixed with the combustion air. The flame temperature is thereby reduced and for a given amount of combustible gas burned at the burner 17, the amount of $NO_x$ produced in the flame is considerably less than if the nitrogen-rich stream had not been added to the combustion air. Since the amount of $NO_x$ produced from the chemically-combined nitrogen contained in the fuel is considerably reduced, and additionally the amount of $NO_x$ produced by nitrogen and oxygen reactions in the flame is also considerably reduced, the flue gas has a relatively low content of $NO_x$ compared to flue gas produced by prior art methods of burning fuels. The $NO_x$ content may be from 5 to 30%, e.g. 15 to 25%, commonly about 20% of that which would be found in the flue gas from conventionally burned fuel, and this reduction in $NO_x$ is achieved without modifying the boiler 19 or reducing its efficiency or operating costs. The said nitrogen-rich stream is recovered from the air-separation plant 12 via line 23, and at least a proportion thereof, determined by the settings of valves 24 and 25, is mixed with the air from fan 21, and the mixed air-nitrogen stream is passed to the burner 17 via line 26.

Thus, the low $NO_x$ benefits of the invention are obtained without the necessity of employing a relatively large diameter pipe or conduit as line 16 to convey combustible gas from the gasifier 14 to the burner 17, and the burner 17 itself may also be relatively small, and these latter features are additional benefits realized by the invention.

Because the gases passing through the gasifier 14 have a smaller volume than they would have if they contained nitrogen, the gasifier 14 may be of reduced size for a given fuel capacity, and/or the size of the gasifier may be such that the upward gas velocity therethrough is reduced, thereby reducing the amount of solids entrained into the combustible gas in line 16.

The oxygen stream in line 13 may be supplemented or replaced by steam without departing from the invention.

Moreover, the burning of the combustible gas may be effected in more than one stage to reduce still further the production of $NO_x$, and nitrogen-rich gas may be added to one or more of the combustion stages to reduce the amount of $NO_x$ produced in each stage.

Where heat is liberated from the air-separation plant 12 (e.g., in the case where air separation is by liquefaction and distillation), improved operational efficiency may be realized by recovering the thus liberated heat in the feed water (or other fluid) which is being circulated to the heat-recovery tubes 18 of the boiler 19.

Reference is now made to FIG. 2, wherein fuel (gaseous and/or liquid and/or solid), e.g. low quality heavy fuel oil or coal or lignite is introduced via line 50 into a gasifier bed 51 containing particles comprising calcium sulfate at an elevated temperature, preferably in the range of from 850° C. to 1150° C., e.g. about 950° C. The bed 51 is supported on a distributor 52 and contained in a gasifier vessel 53. A fluidizing gas which is substantially free of inert diluents is passed from line 54 into the vessel 53 and distributed into the base of the bed 51 via the distributor 52 so that the bed particles are thereby fluidized. The fluidizing gas is selected to contain a mediator to mediate the transfer of oxygen from the $CaSO_4$ of the bed to the fuel. In the course of this transfer, the $CaSO_4$ is reduced to CaS and the fuel is converted to combustible gas which is substantially free of inert diluent components from the fluidizing gas supplied via line 54. The resulting combustible gas passes out of vessel 53 via line 55 which conducts the combustible gas to a burner 56. A minor proportion (e.g. less than 30 vol %, preferably about 10% or less) of the combustible gas is diverted, according to the setting of valves 57, 58,into a recycle circuit for use as at least part of the fluidizing gas furnished to the vessel 53 via line 54. The recycle circuit comprises a recycle fan 59 which passes the gas to a heat exchanger 60 wherein the recycle gas is passed in heat transfer relationship with cooled recycle gas to heat the latter, and the recycle gas leaving the heat exchanger 60 via line 61 is passed to a tar condenser 62 wherein it is cooled to a temperature at which tar-materials and other condensible hydrocarbons are condensed by heat exchange with a suitable medium (e.g. water or low pressure steam passing through coils 63). The tar-materials are recovered via line 64 and may be passed to the bed 51, e.g. by addition to the fuel in line 54, as indicated by broken line 65. The thus cooled, de-tarred recycle gas is passed via line 66 to the heat exchanger 60 and thereby heated to, e.g. 300° to 450° C. The heated recycle gas passes from the heat exchanger 60 to line 54 for distribution into the bed 51. The recycle gas contains, inter alia, $H_2$ and CO, and these components, particularly the hydrogen component, serve to mediate the transfer of oxygen from $CaSO_4$ to the fuel while substantially suppressing the liberation of sulfur from the resulting CaS.

Preferably, the particles in the bed 51 comprise CaO (e.g. as (half-)calcined dolomite, $MgCO_3.CaO$ or MgO.-CaO) which, under the net reducing conditions in the bed 51, fixes sulfur from the fuel as CaS whereby the combustible gas leaving the bed 51 has a low sulfur content (compared to the sulfur content in the absence of a sulfur-fixing agent), and the CaS content of the bed 51 is increased.

The low sulfur combustible gas, substantially free of inert components from the fluidizing gas, is burned at the burner 56 in one or more stages, a combustion-supporting gas, e.g. air, being supplied for the combustion by fan 68 and via line 69 at a rate determined by the setting of valve 70.

Particles, including particles comprising CaS, are circulated from a top region of the gasifier bed 51 via a line 71 to a bottom region of an oxidizer bed 72 contained in an oxidizer 73. Air is supplied by a fan 74 to the base of the oxidizer bed 72 at a rate determined by the setting of valve 75. The air fluidizes the particles in the bed 72 and the oxygen thereof oxidizes CaS therein to $CaSO_4$ with the release of relatively large amounts of heat which raise the temperature of the bed 72 to a temperature which is higher than that of the gasifier bed 51, e.g. 50° to 150° C., preferably about 100° C., higher.

The amount of air passed into the oxidizer bed is regulated to be such that the effluent gas leaving the top 76 of the bed 72 and recovered in line 77 contains a small proportion of the original oxygen content of the air supplied by the fan 74. Thus, the effluent gas recovered in line 77 preferably contains from 0.5 to 6% $O_2$, more preferably from 1 to 5% $O_2$, e.g. from 2.5 to 4% $O_2$, the balance being mainly nitrogen and other gas components of the atmosphere. The presence of a small proportion of oxygen in the effluent gas leaving bed 72 suppresses the liberation of sulfur moieties (e.g. as sulfur oxides) from the CaS being oxidized in the oxidizer bed 72.

Alternatively, the temperature of the bed 72 may be maintained below the temperature at which CaS is oxidized to $CaO+SO_2$, in which case, it is not necessary to ensure that the effluent gas in line 77 contains oxygen, but this mode of practice tends to impose constraints on the operating temperature of the gasifier bed 51, as will be appreciated from the explanation given below, and such constraints could restrict the range of operation of the plant of FIG. 2.

Particles, including particles containing $CaSO_4$, are circulated from a top region of the oxidizer bed 72 via a line 79 to a bottom region of the gasifier bed 51 for use in gasifying further quantities of fuel.

The gas leaving the oxidizer vessel 73 via line 77 is substantially inert apart from the small proportion of oxygen which is preferably therein, and is substantially at the temperature of the oxidizer bed (e.g. about 960° to 1000° C.). For brevity, the gas will be referred to as "inert gas" since for the purposes of the plant of FIG. 2, the gas has an oxygen content (if any) which is so low that it may be considered inert.

The inert gas in line 77 is passed to a heat exchanger 80 where the gas is cooled by heat transfer to boiler feed water and/or saturated steam. The boiler feed water and/or saturated steam is supplied to the heat exchanger 80 from a pump or circulating fan 81, and the resulting heated water and/or steam is passed via line 82 to the steam coils, indicated by 83, of a boiler 84, the heated steam being recovered via line 85.

The inert gas leaving the heat exchanger 80 is at a temperature in the range of, e.g. 300° to 600° C., e.g. about 450° C., and preferably passes next to another heat exchanger 86 where it gives up heat to a water stream supplied by pump 87 to produce steam which is recovered in line 88. The amount of steam thus raised is preferably relatively small (compared to that generated in heat exchanger 80) and is at a temperature in the range of, e.g. 200° to 550° C., for example 400° to 475° C., and at least some of the steam in line 88 is conducted to the gasifier vessel 53 where it is injected as a component of the fluidizing gas to fluidize the bed 51.

The steam thus incorporated in the fluidizing gas is to provide a mediator for the reaction between the solid $CaSO_4$ and the fuel by initially reacting with carbon to form hydrogen and CO which serve as mediators even in very small concentrations. The steam may replace at least part of the recycled combustible gas from line 54, with consequent savings in equipment and operating costs, although a fluidizing gas comprising about 30 to 35 vol % recycled combustible gas (e.g. about ⅓rd) and about 70 to 65 vol % steam (e.g. about ⅔rds) provides satisfactory performance and economics.

The inert gas leaves the heat exchanger 86 at a relatively low temperature, e.g. 100° to 350° C., and at least some of it is passed to the burner 56 (the amount depending on the setting of valves 90, 91) via line 92. As depicted in FIG. 2, the inert gas is mixed with the combustion air supplied from fan 68, and the thus diluted combustion air is passed to the burner 56 where it causes the flame temperature of the burning combustible gas to be lower than it would otherwise be using undiluted combustion air, thereby reducing the generation of $NO_x$ pollutants in the resulting flue gas.

The gasification of sulfur-containing fuel in gasifier 51 causes an increase in the sulfur content of the bed particles as sulfur is fixed as CaS. In order to avoid a continued increase in the sulfur-content of the bed particles, bed particles are circulated from the gasifier bed 51 and/or the oxidizer bed 72 to a regenerator wherein solid compounds of calcium and sulfur are treated to regenerate CaO, and sulfur moieties are liberated.

As shown in FIG. 2, particles are transferred from a top region of the oxidizer bed 72 via a conduit 94 to a bottom region of a regenerator bed 95 contained in a regenerator vessel 96. A suitable fluidizing gas is passed into the base of the bed 95 from a fan 97 and, if necessary, a fuel is passed into the regenerator bed 95 for part-combustion therein. If the particles undergoing regeneration comprise $CaSO_4$, the fluidizing gas from fan 97 may be air, and any fuel may be passed into the bed to reduce the $CaSO_4$ to CaO with the liberation of sulfur moieties. The fuel may be a small proportion of the fuel undergoing gasification in gasifier bed 51 or it may be combustible gas produced in the gasifier bed 51. If the particles undergoing regeneration comprise CaS, no fuel need be passed into the bed 95 since exothermic regeneration to CaO proceeds when the bed is fluidized by air.

Hot particles of reduced sulfur content are circulated from a top region of the regenerator bed 95 to a bottom region of the oxidizer bed 72 via conduit 98 for use in fixing further amounts of sulfur from the fuel.

The invention is not confined to the specific arrangements of each of the described embodiments, and it will be appreciated that a feature or combination of features used in one embodiment may be employed in another embodiment if technically feasible. It will also be apparent that the invention can be applied in existing boiler installations, suitably modified, if necessary.

I claim:

1. A low pollution method of burning a fuel, comprising the steps of:

(a) passing the fuel into a dense phase fluidized bed of particles which are fluidized by a fluidizing gas substantially free of non-combustible inert components;

(b) partially oxidizing the fuel within the dense phase bed at an elevated partial oxidation temperature to produce a combustible gas which has a low content of non-combustible inert components.

(c) passing at least some of the combustible gas to a burner; and (d) burning the combustible gas in a flame at the burner with a combustion-supporting gas to which has been added a non-combustible inert gas to suppress or reduce the formation of pollutants in the resulting flue gas.

2. A method as in claim 1 in which the partial oxidation of step (b) is effected with oxygen and/or steam substantially free of non-combustible inert substances.

3. A method as in claim 2 in which the oxygen is obtained by separation from air.

4. A method as in claim 3 where the non-combustible gas is nitrogen.

5. A method as in claim 4 in which the nitrogen is obtained by separating oxygen from air.

6. A method as in claim 5 in which oxygen is separated from air by a procedure comprising liquefying the air, and recovering at least some of the heat made available by the air liquefaction procedure in a fluid selected from one or more of the following: water, steam or other fluid passing to a boiler, or at least part of the gas which is employed to convert fuel to combustible gas.

7. A method as in claim 1 in which the particles in the dense phase fluidized bed include particles comprising reactive calcium sulfate, and in which the fuel is partially oxidized within the bed at an elevated temperature by the transfer to the fuel of oxygen from calcium sulfate, which is thereby reduced to reactive calcium sulfide, contacting particles comprising reactive calcium sulfide in an oxidizing zone with a gas mixture comprising molecular oxygen and at least one gaseous component which is non-combustible and inert at conditions such that at least some reactive calcium sulfide is converted to reactive calcium sulfate which is re-used for the partial oxidation of further amounts of fuel, and such that a substantially oxygen-free non-combustible inert residue gas at an elevated temperature is produced, and employing said residue gas as the non-combustible inert gas in step (d) of claim 1.

8. A method as in claim 7 in which the residue gas is cooled by heat exchange with a fluid before addition to the combustion supporting gas, and wherein said fluid is selected from at least one of the following: water, steam or other fluid passing to a boiler.

9. A method as in claim 8 in which the fuel contains chemically-combined sulfur and/or chemically-combined nitrogen, and in which the fluidized bed comprises particles containing reactive calcium oxide which fixes sulfur from the fuel as reactive calcium sulfide to reduce the sulfur content of the combustible gas.

10. A boiler installation comprising a dense phase fluidized bed fuel conversion zone wherein a fuel is partially oxidized within a dense phase fluidized bed which is fluidized by a fluidizing gas substantially free of non-combustible inert components to form a combustible gas which has a low content of non-combustible inert components; a burner connected to receive combustible gas from the said fuel conversion zone, means operable to provide a supply of non-combustible inert gas, means operable to provide a supply of combustion-supporting gas, and means for conducting a mixture of said non-combustible inert gas and said combustion-supporting gas to the burner to burn the combustible gas in a flame at the burner with a reduced peak flame temperature.

11. A method as in claim 7 wherein the transfer to the fuel of oxygen from calcium sulfate is conducted in the presence of a mediating gas and/or vapour moiety for mediating and/or promoting the transfer of oxygen.

12. The method as in claim 11 wherein the mediating gas and/or vapour moiety is selected from the group consisting of CO and $H_2$.

13. A method as in claim 7 wherein the residue gas is cooled by heat exchange with at least a part of the gas mixture which subsequently is utilized for conversion of calcium sulfide to calcium sulfate.

14. The method of claim 9 wherein particles containing reactive calcium sulfide are fluidized in a regeneration zone at a regeneration temperature by an oxygen-containing gas whereby reactive calcium sulfide is converted to reactive calcium oxide with the liberation of at least one sulfur moiety.

15. The method of claim 14 wherein calcium oxide is used for fixing sulfur from further amounts of fuel in the dense phase fluidized bed.

* * * * *